United States Patent [19]

Kanzaka et al.

[11] Patent Number: 4,571,781

[45] Date of Patent: Feb. 25, 1986

[54] DRAINABLE BUTTON ASSEMBLY

[75] Inventors: Yoshihiro Kanzaka, Nyuzen; Masahiko Ito, Funabashi, both of Japan

[73] Assignee: Nippon Notion Kogyo Co., Ltd., Tokyo, Japan

[21] Appl. No.: 535,080

[22] Filed: Sep. 23, 1983

[30] Foreign Application Priority Data

Sep. 25, 1982 [JP] Japan ..... 57-144884[U]

[51] Int. Cl.[4] ..... A44B 1/42

[52] U.S. Cl. ..... 24/95; 24/113 R; 24/687

[58] Field of Search ..... 24/90 R, 90 A, 90 C, 24/90 E, 92, 94, 103, 113 R, 113 MP, 620–622, 687–691, 696, 95; 40/315

[56] References Cited

U.S. PATENT DOCUMENTS

| | | | |
|---|---|---|---|
| 358,080 | 2/1887 | Smith | 24/113 MP X |
| 1,270,467 | 6/1918 | Vogelsang | 24/90 R |
| 1,305,275 | 6/1919 | Geen | 24/113 R |
| 1,702,768 | 2/1929 | Ford | 24/90 R X |
| 1,867,424 | 7/1932 | Smith | 24/90 A |
| 2,067,222 | 1/1937 | Wolff | 24/90 A |
| 2,072,218 | 3/1937 | Richardson | 24/95 X |
| 2,179,522 | 11/1939 | Purinton | 24/90 A |
| 2,254,446 | 9/1941 | Purinton | 40/315 X |
| 2,574,436 | 11/1951 | Maxim | 24/90 R X |
| 3,249,974 | 5/1966 | Connolly | 24/113 MP |

FOREIGN PATENT DOCUMENTS

| | | | |
|---|---|---|---|
| 114844 | 3/1942 | Australia | 24/90 R |
| 324285 | 8/1920 | Fed. Rep. of Germany | 24/90 R |
| 675476 | 5/1939 | Fed. Rep. of Germany | 24/696 |

*Primary Examiner*—William E. Lyddane
*Assistant Examiner*—James R. Brittain
*Attorney, Agent, or Firm*—Hill, Van Santen, Steadman & Simpson

[57] ABSTRACT

A button includes a button body having a funnel-shaped button back and a cap mounted on a wide end of the button back, and a tack member adapted to be joined with the small end of the button back for attachment of the button to a garment fabric, the button as attached to the garment fabric defining a hollow interior. The button body includes at least one channel extending between an inclined outer peripheral portion of the button back and an annular rim of the cap secured to the inclined outer peripheral portion. A liquid which has entered in the button's hollow interior can be drained through the channel from the hollow interior.

3 Claims, 4 Drawing Figures

DRAINABLE BUTTON ASSEMBLY

BACKGROUND OF THE INVENTION

1. Field of the Invention

The present invention relates to a button including a capped button body and a tack member adapted to be joined with the body for attachment of the button to a garment fabric, and particularly to such button having a substantially hollow interior as it is attached to the garment fabric.

2. Prior Art

There are known various buttons of the type described which include a button body with a cap thereon and a tack member adapted to be joined with the body for attachment of the button to a garment fabric. The button body includes a hollow stem receptive of a shank of the tack member and having at one end a flange on which the cap is mounted. The button as attached to the garment fabric has a substantially hollow interior. With this arrangement, water or a solution would seep in and be entrapped in the button's hollow interior during washing or dyeing of the garment fabric and such entrapped liquid gradually corrodes the material of the button as time goes by. The button thus corroded is likely to stain the garment fabric and sometimes liquid drips from the same.

SUMMARY OF THE INVENTION

It is therefore an object of the present invention to provide a button which is resistant to corrosion and hence can be held stably in position on the garment fabric for a long time without staining the garment fabric.

Another object of the present invention is to provide a button having means for draining water or other liquid entrapped in a hollow interior of the button.

According to the invention, a button includes a button body having a funnel-shaped button back and a cap mounted on a wide end of the button back, and a tack member adapted to be joined with the small end of the button back for attachment of the button to a garment fabric, the button as attached to the garment fabric defining a hollow interior. The button body includes means for draining a liquid from the hollow interior of the button. The draining means comprises at least one channel extending between an inclined outer peripheral portion of the button back and an annular rim of the cap which is secured to the inclined outer peripheral portion. A liquid which has entered in the button's hollow interior can be drawn through the channel from the hollow interior.

Many other advantages and features of the present invention will become manifest to those versed in the art upon making reference to the detailed description and the accompanying sheets of drawings in which preferred structural embodiments incorporating the principles of the present invention are shown by way of illustrative example.

BRIEF DESCRIPTION OF THE INVENTION

DETAILED DESCRIPTION

Figure 1:
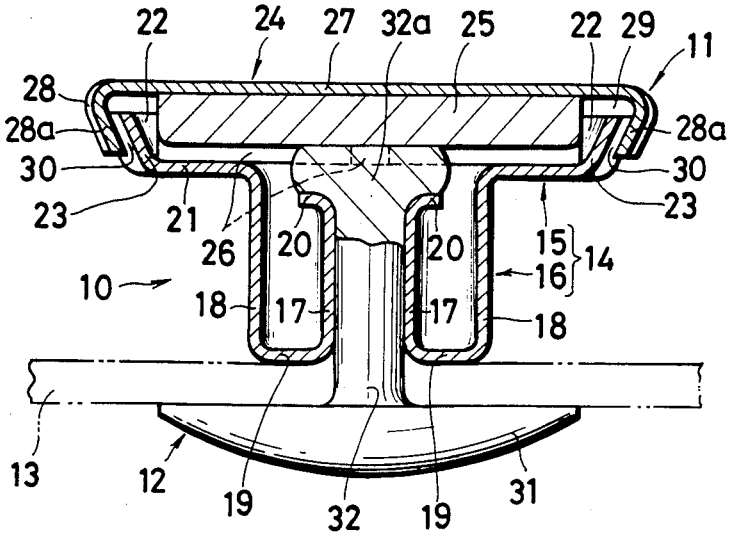
FIG. 1 is a vertical cross-sectional view of a button according to the present invention, showing the button having been attached to a garment fabric.

The present invention is particularly useful when embodied in a button such as shown in FIG. 1, generally indicated by the numeral 10.

The button 10 comprises a capped button body 11 and a tack member 12 attaching the button 10 to a garment fabric 13.

The button body 11 includes a substantially funnel-shaped button back 14 composed of an annular head 15 and a hollow stem 16 projecting downwardly from an inner edge of the annular head 15. The hollow stem 16 is in the form of a double tube of circular cross section which is composed of a pair of concentric inner and outer tubes 17, 18 joined at their lower end by an annular turn 19. The inner tube 18 has at its upper end an outwardly directed annular flange 20.

Figure 2:
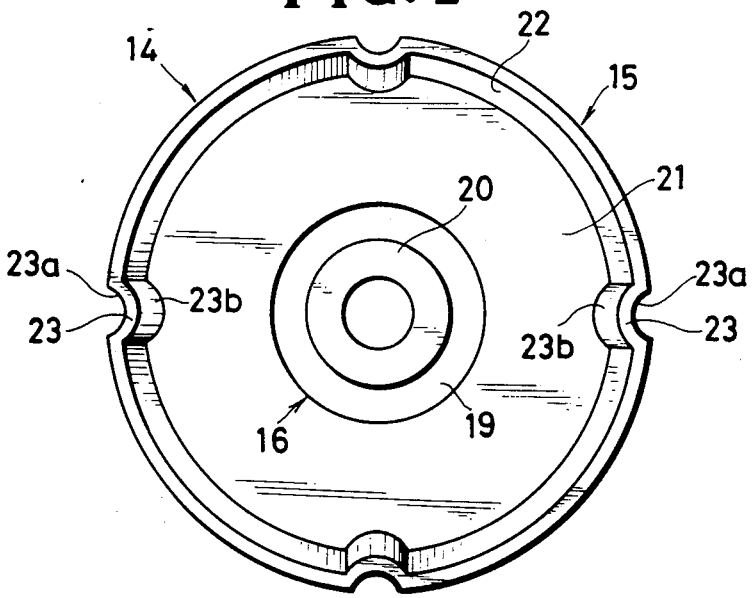
FIG. 2 is a plan view of a button body of the button shown in FIG. 1.

The annular head 15 is composed of a substantially circular flange portion 21 leading from an upper end of the outer tube 18, and an inclined annular peripheral portion 22 extending radially outwardly and axially from the flange portion 21. The flange portion 21 extends substantially perpendicularly to the axis of the hollow stem 16 and lies in a plane extending above the plane of the flange 20. The peripheral portion 22 has a plurality of ribs 23 (four being shown in FIG. 2) extending across the annular peripheral portion 22, the ribs 23 being angularly spaced at equal angular intervals. The ribs 23 are formed by pressing portions out of the peripheral portion 22 toward the center of the annular head 15. Therefore, each of the ribs 23 provides a groove **23*a* opening radially outwardly away from the center of the head 15 and an opposite ridge 23*b* projecting radially inwardly toward the center of the head 15, as shown in FIG. 2**.

Figure 4:
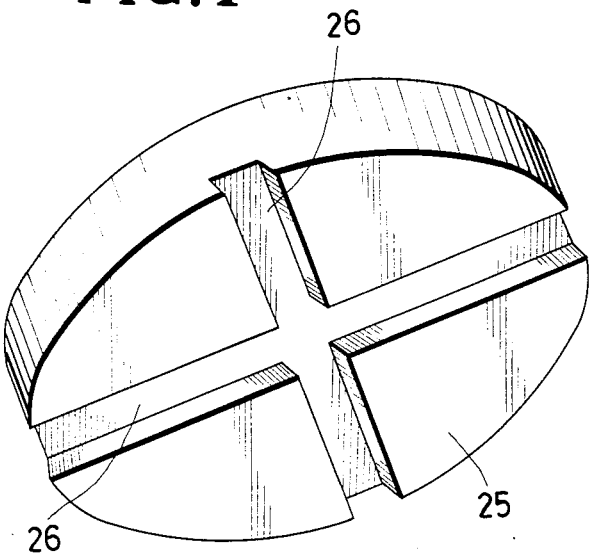
FIG. 4 is a perspective view from below of a backplate 25 of FIG. 4.

The button body 11 also includes a cap 24 mounted on the head 15 of the button back 14, and a circular back plate 25 sandwiched between the head 15 and the cap 24. The back plate 25 has in one surface a plurality of radially extending slots 26 (three being shown in FIG. 1 and four in FIG. 4), and is placed on the flange portion 21 of the head 15 with the slots 26 opening toward the stem 16. The tack member 12, the button back 14 and the cap 24 are preferably made of brass, and the back plate 25 is preferably made of iron or steel. The back plate 25 has a thickness which is larger than the width of the annular peripheral portion 22 of the head 15 so that the back plate 25 projects upwardly beyond the head 15. The cap 24 includes a substantially flat upper wall 27 and an inclined annular rim 28 extending radially inwardly and axially from an outer circumferential edge of the upper wall 27. The annular rim 28 of the cap 24 prior to being mounted on the button back's head 15 is somewhat distorted.

In attachment, the back plate 25 and the cap 24 are first placed on the head 15 with the upper wall 27 supported on the back plate 25. Then, by means of a presser tool the annular rim 28 is deformed radially inwardly into the shape shown in FIG. 1 until the annular rim 28 is firmly pressed against the peripheral portion 22. During that time, the annular rim 28 becomes recessed at the ribs 23 on the peripheral portion 22 so that four protrusions **28*a* are formed on the annular rim 28. Each of the protrusions 28*a* projects into a corresponding one of the grooves 23***a* of the respective ribs 23, and terminates short of the bottom of the groove 23*a*. The button body 11 thus assembled has an annular space 29 defined between the upper wall 27 of the cap 24 and an edge of the peripheral portion 22, and a set of four channels 30 defined respectively between the ribs 23 and the protrusions 28*a*, the channels 30 communicating with the annular space 29.

The tack member 12 before having been joined with the button body 11 includes a head 31 and a shank 32 of circular cross-section projecting perpendicularly and centrally from the head 31 for being inserted through the hollow stem 16 of the button back 14. Although not shown, the shank 32 initially has a pointed tip end.

To attach the button 10 to the garment fabric 13, the shank 32 of the tack member 12 is pierced through the garment fabric 13 and is then inserted through the inner tube 17 of the button back's hollow stem 16. With continued insertion of the shank 32, the tip end of the shank 32 is deformed into an enlarged foot 32*a* compressed axially and spread radially between the back plate 25 and the annular flange 20 of the inner tube. The enlarged foot 32*a* has portions received in the slots 26 in the back plate 25.

With the button 10 thus attached on the garment fabric 13, a liquid such as water or a solution, which has entered into the hollow interior of the button 10 during washing or dyeing of the garment fabric 13, can be drained from the button's hollow interior through a continuous passage defined jointly by the slots 26, the space 29 and the channels 30. As the enlarged foot 32*a* of the shank 32 is partly received in the slots 26 in the back plate 25, the button body 11 is prevented from being rotated with respect to the tack member 12. Further, rotation of the cap 24 with respect to the button back 14 is prevented by the protrusions 28*a* held in engagement with the rib's grooves 23*a*.

Figure 3:
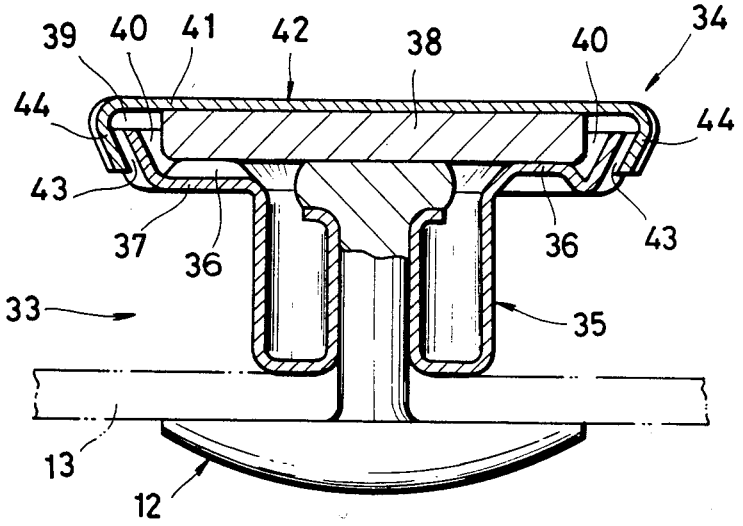
FIG. 3 is a view similar to FIG. 1, showing another embodiment.

A modified button 33 shown in FIG. 3 is substantially similar to the button 10 shown in FIG. 1, but is different therefrom in that a button body 34 includes a button back 35 having a plurality of ribs 36 (two being shown) extending on and radially across an annular flange portion 37 of the button back 35, the ribs 36 being spaced at equal angular intervals. A back plate 38 has an opposite flat surface and is disposed on the ribs 36 of the button back's flange portion 37. With the button 34 thus constructed, a liquid which has been entrapped in a hollow interior of the button 34 can be drained through spaced defined between adjacent ribs 36 and the back plate 38, a space 39 between an inclined annular peripheral portion 40 of the button back 35 and an upper wall 41 of a cap 42, and channels 43 between the peripheral portion 40 and an annular rim 44 of the cap 42.

Although various minor modifications may be suggested by those versed in the art, it should be understood that we wish to embody within the scope of the patent warranted hereon, all such embodiments as reasonably and properly come within the scope of our contribution to the art.

We claim as our invention:

1. A button assembly adapted to drain any liquid therefrom when attached to a garment fabric, said button assembly comprising:

(a) a button body including a button back and a cap covering said button back on its one obverse side, said button back having an annular head and a hollow stem disposed remotely from said cap and projecting from an inner edge of said annular head, said annular head having an inclined outer peripheral portion extending radially outwardly and axially of said annular head, said cap having an annular rim secured to said inclined outer peripheral portion, said annular head having a central flange portion extending between said inclined outer peripheral portion and said inner edge of said annular head, and including a backplate disposed between said flange portion and said cap and having one surface lying in a plane extending above the plane defined by an edge of said inclined outer peripheral portion of said annular head;

(b) a tack member including a head and a shank projecting perpendicularly and centrally from said head for being pierced through the garment fabric and then inserted into said hollow stem of said button back to thereby join said tack member with said button body, said button body and said tack member as joined together defining therebetween a hollow interior in said button assembly;

(c) means for draining a liquid from said hollow interior of said button assembly, said draining means including at least one channel extending between said inclined outer peripheral portion of said annular head and said annular rim of said cap and communicating at opposite ends with said hollow interior of said assembly and the atmosphere; and (d) said backplate having at least one radially extending slot provided in the surface opposite said one surface and forming part of said draining means, said slot opening away from said cap and held in communication with said channel.

2. A button assembly according to claim 1, said inclined outer peripheral portion of said annular head of said button back having at least one groove extending radially across said inclined outer peripheral portion of said body and opening outwardly of said annular head of said button back, said channel being defined between said groove of said annular head and said annular rim of said cap; said annular rim having a protrusion projecting radially into said groove and terminating short of the bottom of said groove.

3. A button according to claim 1 said draining means including an outer rib in said inclined outer peripheral portion providing a groove and an opposite ridge.

* * * * *